United States Patent [19]

Iuchi et al.

[11] Patent Number: 4,866,907

[45] Date of Patent: Sep. 19, 1989

[54] PACKAGING MACHINE

[75] Inventors: Tetsuya Iuchi; Masao Nobuta; Seiji Hashimoto, all of Tokushima, Japan

[73] Assignee: Shikoku Kakoki Co., LTD., Tokushima, Japan

[21] Appl. No.: 192,995

[22] Filed: May 12, 1988

[30] Foreign Application Priority Data

May 13, 1987 [JP] Japan ..... 62-71339[U]

[51] Int. Cl.[4] ..... B65B 7/28

[52] U.S. Cl. ..... 53/299; 53/300; 53/307; 53/367

[58] Field of Search ..... 53/282, 299, 300, 307, 53/329, 367

[56] References Cited

U.S. PATENT DOCUMENTS

| | | | |
|---|---|---|---|
| 2,826,884 | 3/1958 | Eddison et al. | 53/367 X |
| 3,270,487 | 9/1966 | Tchimenoglov et al. | 53/282 X |
| 3,415,034 | 12/1968 | Schmitt | 53/367 X |
| 3,487,622 | 1/1970 | Mueller | 53/282 X |
| 3,884,017 | 5/1975 | Butcher | 53/329 X |
| 4,077,180 | 3/1978 | Agent et al. | 53/282 X |

*Primary Examiner*—Robert L. Spruill
*Assistant Examiner*—Beth Bianca
*Attorney, Agent, or Firm*—Armstrong, Nikaido, Marmelstein, Kubovcik & Murray

[57] ABSTRACT

A packaging machine comprising a conveyor drivingly movable intermittently for transporting containers and having a capping station, the conveyor having a plurality of holders each adapted to support the container at its opening rim portion, the holders being stoppable at the capping station one after another; an assembly for capping the container by fitting the skirt of a cap to the opening rim portion of the container at a capping position above the path of travel of the holders in the capping station; and an assembly for centering the cap skirt and the container opening rim portion relative to each other for capping.

6 Claims, 5 Drawing Sheets

PACKAGING MACHINE

BACKGROUND OF THE INVENTION

The present invention relates to a packaging machine which comprises a conveyor for transporting containers containing dessert such as pudding, jelly, yogourt or ice cream and in which the containers are capped during the transport.

FIG. 6 shows a cup-shaped container C1, a plastic cap C2 covering the upper end of the container and an intermediate planar closure C3 of aluminum foil closing the opening of the container C1 and covered with the cap C2.

With the above-mentioned container C1 and cap C2, there is a difference between the outside diameter A of the opening rim portion of the container C1 and the inside diameter B of the lower edge of skirt of the cap C2 to give a clearance between the container C1 and the cap C2. If this clearance is, for example, about 1 mm, no problem will occur, whereas when it is as small as about 0.3 to about 0.4 mm, such containers can not be capped by a machine at a high speed, necessitating a manual capping procedure.

Even if the clearance is about 0.3 to about 0.4, a cap C4 shown in FIG. 7 and having a curved flaring skirt lower edge can be fitted to the container by a machine. However, the cap C4 with such a curved skirt is not fully satisfactory since the cap has problems with respect to the manufacturing cost and appearance.

SUMMARY OF THE INVENTION

The main object of the invention is to provide a packaging machine which is adapted for a high-speed capping operation even if the clearance between the container and the cap is small.

The present invention provides a packaging machine which comprises a conveyor drivingly movable intermittently for transporting containers and having a capping station, the conveyor having a plurality of holders each adapted to support the container at its opening rim portion, the holders being stoppable at the capping station one after another; an assembly for capping the container by fitting the skirt of a cap to the opening rim portion of the container at a capping position above the path of travel of the holders in the capping station; and an assembly for centering the cap skirt and the container opening rim portion relative to each other for capping.

According to the present invention, the cap skirt and the container rim portion are centered by the centering assembly when the container is to be capped, so that containers can be capped at a high speed free of any trouble even if the clearance between the container and the cap is small.

BRIEF DESCRIPTION OF THE DRAWINGS

FIG. 1 is a front view;

FIGS. 2 and 3 are enlarged views in section taken along the line II—II and the line III—III in FIG. 1, respectively;

FIG. 4 is a view in section taken along the line IV—IV in FIG. 2;

FIG. 5 is a vertical cross sectional view of a positioning member; and

DESCRIPTION OF THE PREFERRED EMBODIMENT

Figure 1:
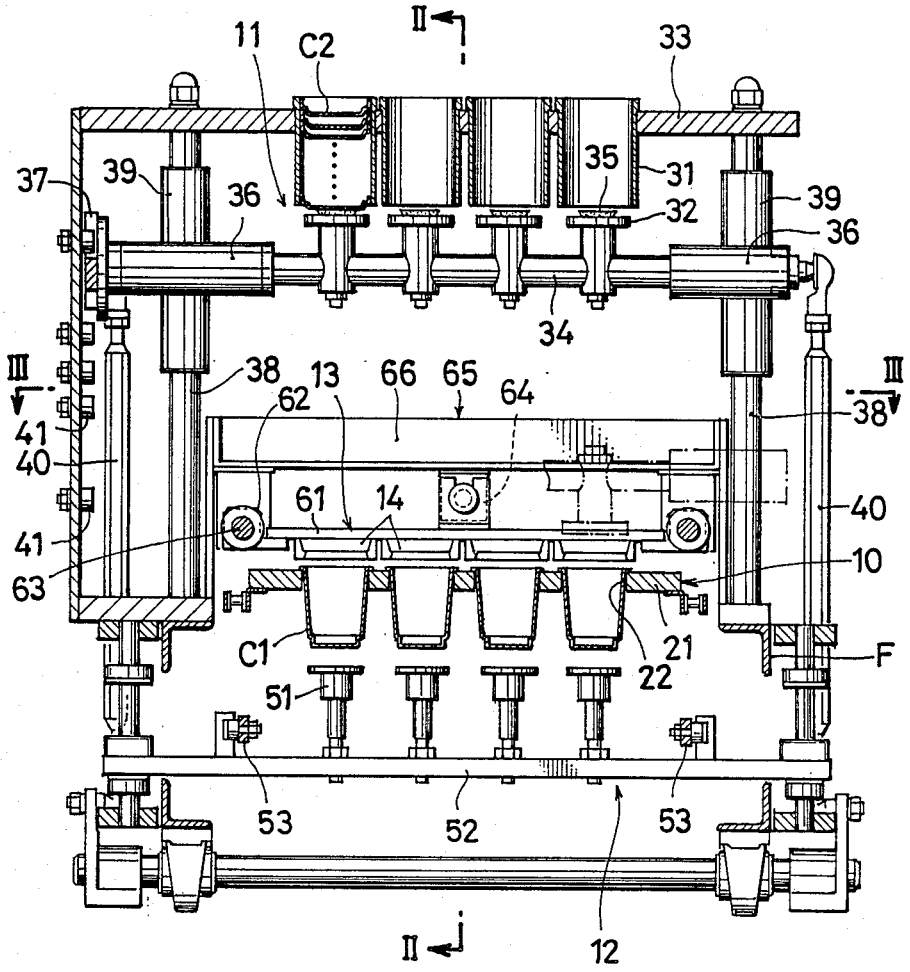
FIGS. 1 to 5 show an embodiment of the invention.
Figure 2:
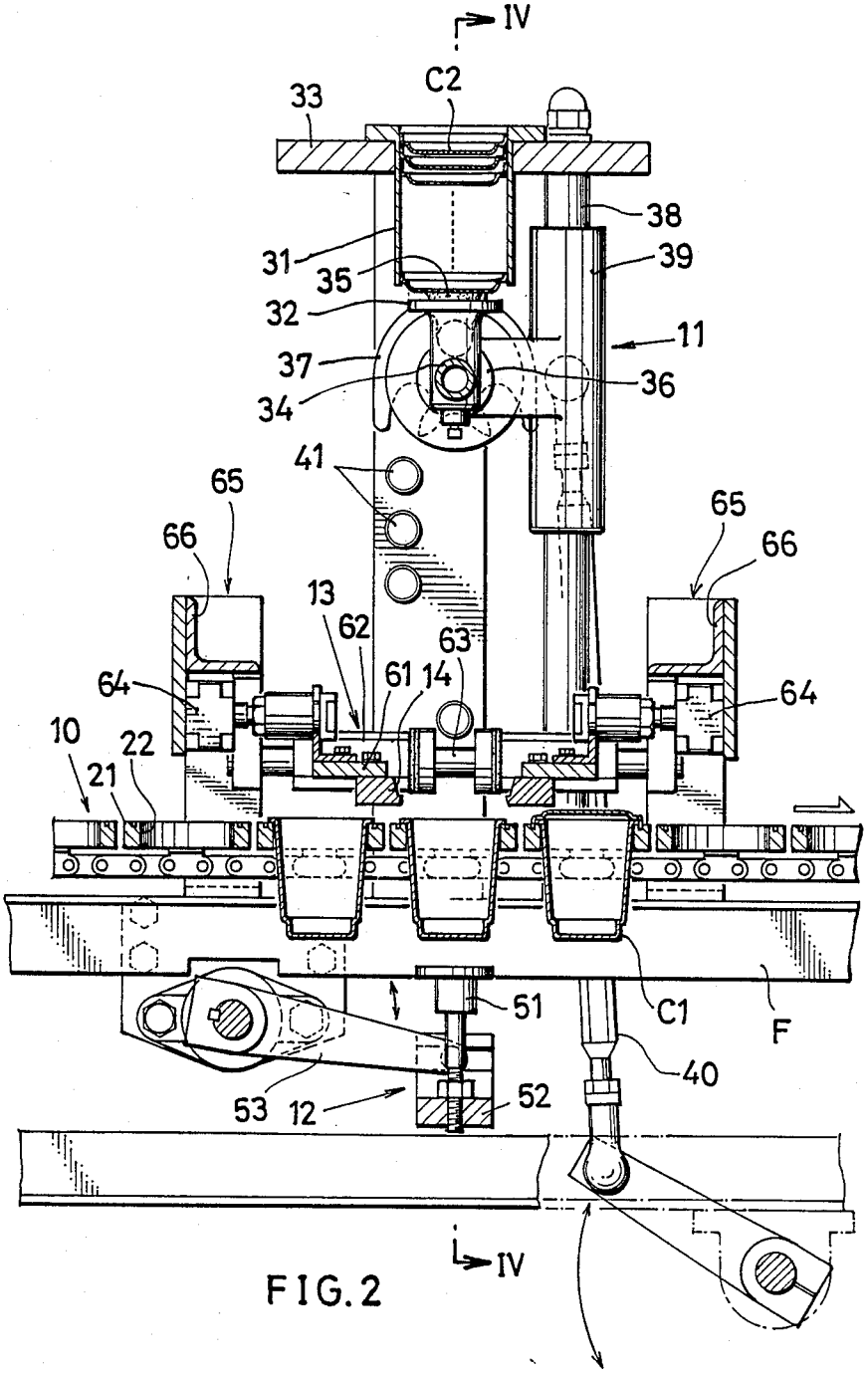
Figure 3:
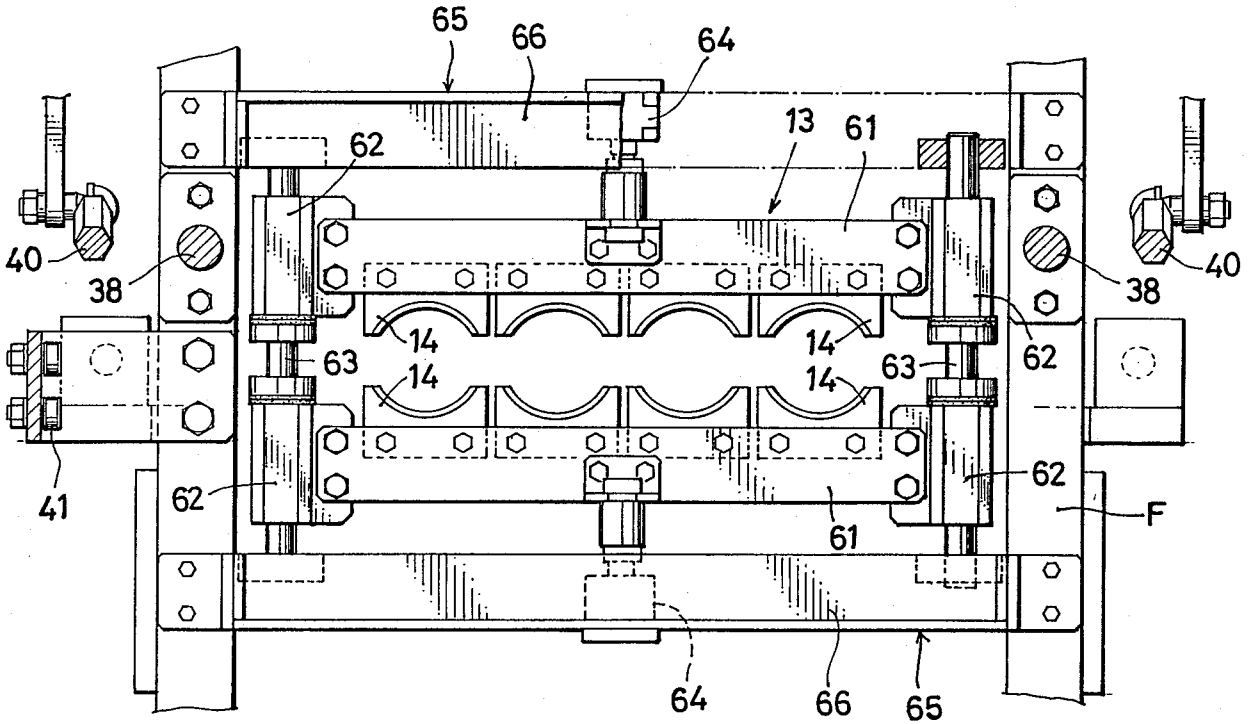
Figure 4:
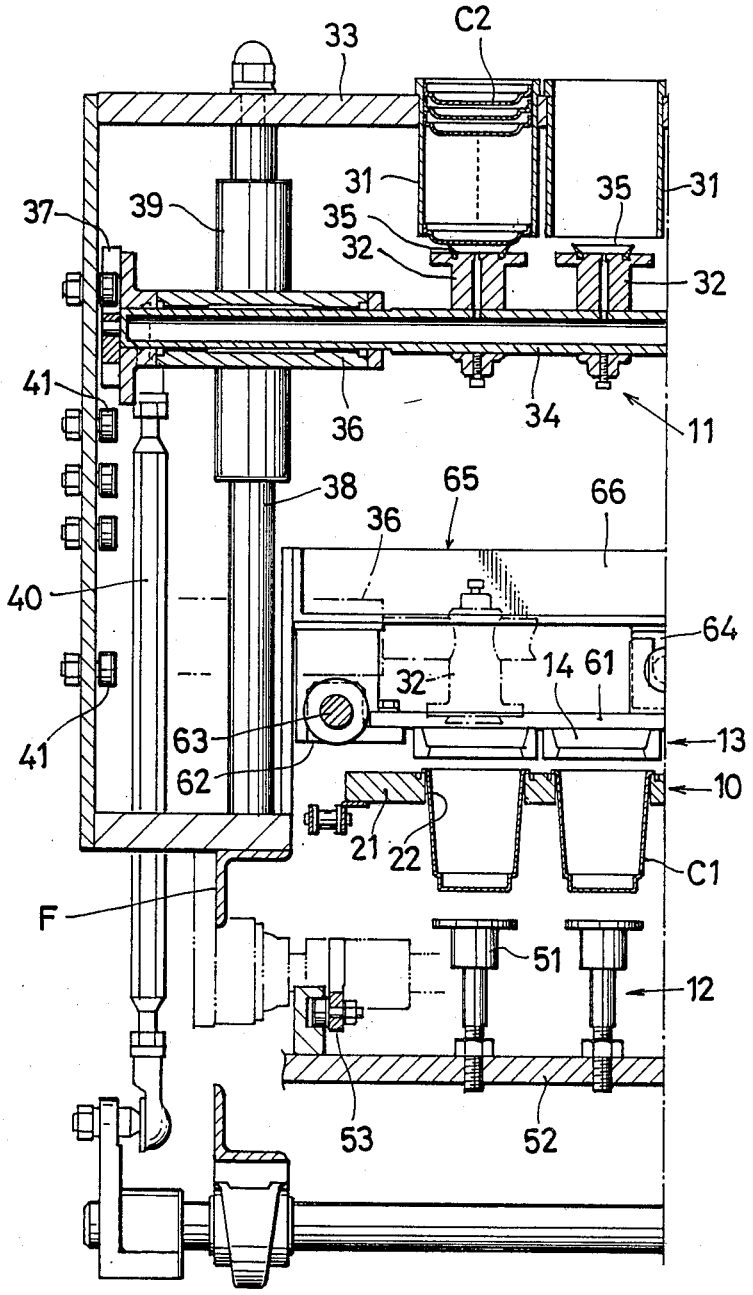
Figure 5:
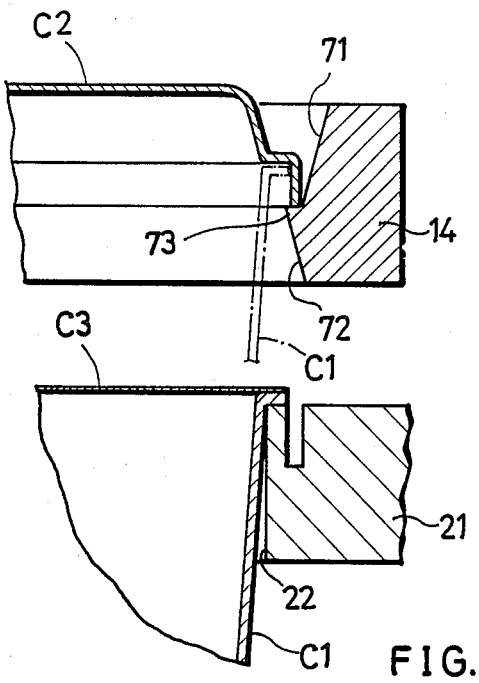
Figure 6:
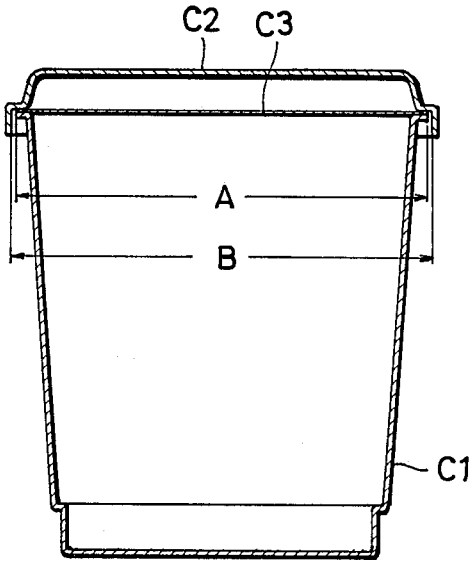
FIGS. 6 and 7 are views in vertical section showing different combinations of a container and a cap.
Figure 7:
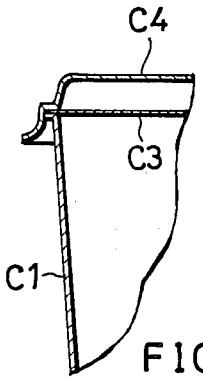

An embodiment of the invention will be described with reference to FIGS. 1 to 5.

A capping assembly 11 is disposed above the path of transport of containers C1 by a conveyor 10 at a capping station. A container lifter 12 is provided under the path at the station. Immediately above the path of transport between the capping assembly 11 and the container lifter 12, there are capping positions where a centering assembly 13 is disposed.

The conveyor 10 is a slat conveyor for intermittently transporting cup-shaped containers C1 in four rows and has slats 21 each having holes 22 arranged longitudinally thereof. The container C1 has at its opening rim portion a flange which is supportable by the upper edge of the hole-defining inner periphery of the slat 21, with the container C1 inserted in each hole 22.

The capping assembly 11 comprises four holders 31 provided for the four rows of containers to be transported, respectively, for holding a stack of inverted caps C2, and four suction members 32 disposed under the four holders 31, respectively, and each adapted to transport caps C2 from the lower end of the holder 31 to the capping position one by one while inverting the cap to a top-up state after attracting the cap thereto. The holders 31, which are tubular, extend through and are attached to a horizontal support plate 33 provided over the path of transport transversely thereof. The suction members 32 are secured to a horizontal rotatable rod 34 disposed below the support plate 33 and are radially projected therefrom. Each suction member 32 has a vacuum cup 35 at its forward end. The horizontal rotatable rod 34 is supported close to its opposite ends by bearings 36 and provided with a rotating plate 37 at its one end. Each of the bearings 36 is supported by a tubular lift member 39 slidably fitted around a vertical guide rod 38. The lift member 39 is connected to an operating rod 40 for moving the member 39 upward or downward. With the upward or downward movement of the lift members 39, the rotating plate 37 also moves upward or downward and is reversibly rotated by a plurality of guide rollers 41 arranged along the path of movement of the plate 37, through 180 degrees in either direction, whereby the suction members 32 are reversibly rotated through 180 degrees in either direction while moving upward or downward.

The container lifter 12 has four lift tables 51 provided for the four rows of containers, respectively. The four lift tables 51 are mounted in an upwardly projecting position on a horizontal lift bar 52 and are arranged at a spacing longitudinally thereof. Operating levers 53 for raising or lowering the lift bar 52 are connected to the bar 52. When the lift bar 52 is raised or lowered by the operating levers 53, the four lift tables 51 are raised or lowered at the same time. During rising, the lift tables 51 raise the containers C1 off the slat 21 so as to insert the opening rim portions of the containers C1 into the caps C2 at the capping positions.

The centering assembly 13 has four pairs of positioning members 14 provided for the four rows of containers to be transported, respectively. Each pair of positioning members 14 are mounted on a pair of movable plates 61 so as to be arranged along the direction of transport of the container. Each of the movable plates 61 is supported at its opposite ends by a pair of slide sleeves 62 on a pair of horizontal guide rods 63 extending along the direction of transport. The pair of guide rods 63 are connected between horizontal top members 66 of a pair of gatelike frames 65 extending over the path of transport transversely thereof and respectively positioned upstream and downstream from the capping station with respect to the transport direction. The frames 65 are supported by the frame F of the conveyor 10. A pair of horizontal hydraulic cylinders 64 which are opposed to each other are attached to the respective top members 66 of the gatelike frames 65, each at the lengthwise midportion of the member 66, and have their piston rods connected to the respective movable plates 61. The hydraulic cylinders 64, when operated, move the movable plates 61 with the positioning members 14 toward or away from each other. Each pair of positioning members 14 have opposed faces each generally in the form of a circular arc when seen from above and each including an upward tapered portion 71 for positioning the cap C2, a downward tapered portion 72 provided under the upward tapered portion 71 for positioning the container C1, and a stepped portion 73 between the two tapered portions 71, 72. When the pair of positioning members 14 are brought close to each other, the lower ends of the upward tapered portions 71 assume a circular form in conformity with the contour of the lower edge of the cap skirt, and the upper ends of the downward tapered portions 72 make a circular arc form in conformity with the contour of the opening rim portion of the container C1.

When a slat 21 is stopped under the capping positions, the pairs of positioning members 14 are closed. Approximately at the same time, each of the suction members 32 attracts a cap C2 from the lower end of the holder 31, lowers while rotatating and feeds the cap C2 to the space between the opposed faces of the pair of positioning members 14. At this time, the skirt lower edge of the cap C2 is guided by the pair of upward tapered portions 71 from outside, whereby the cap C2 is positioned properly with respect to the horizontal direction, and the contact of the skirt lower end of the cap C2 with the pair of stepped portions 73 permits the cap C2 to come into and remain in a horizontal position properly. Each of the lift tables 51 then rises, thereby lifting the container C1 from the slat 21. At this time, the opening rim portion of the container C1 is guided by the downward tapered portions 72 of the pair of positioning members 14 from outside while passing therebetween, whereby the container C1 is positioned properly with respect to the horizontal direction. The opening rim portion is inserted into the skirt of the cap C2 in this state, whereby the container C1 is covered with the cap C2. When the four containers C1 have been capped completely in this way, the suction members 32 are raised while being inverted, and approximately at the same time, the positioning members 14 are opened. Subsequently, the lift tables 51 are lowered, returning the capped containers C1 to the slat 21. The slat 21 is then driven by one pitch to deliver the capped containers C1 from the capping station, i.e. from below the capping positions. At the same time, the containers C1 to be subsequently capped are fed to the capping station.

What is claimed is:

1. A packaging machine comprising:

a conveyor drivingly movable intermittently for transporting containers having an opening rim portion and having a capping station, the conveyor having a plurality of holders each adapted to support a container at its opening rim portion, the holders being stoppable at the capping station one after another, an assembly for capping the containers by fitting the skirt of a cap to the opening rim portion of a container at a capping position above the path of travel of the holders in the capping station, an assembly in the capping position for centering the cap skirt and the container opening rim portion relative to each other comprising positioning members having an upward tapered portion for positioning a cap moved downwardly from above joined with a downward tapered portion for positioning a container moved upwardly from below and a stepped portion between the two portions, and means for moving a cap and a container into said respective tapered portions of said centering assembly to be joined therein.

2. A packing machine comprising:

a conveyor drivingly movable intermittently for transporting containers having an opening rim portion and having a capping station, the conveyor having a plurality of holders each adapted to support a container at its opening rim portion, the holder being stoppable at the capping station one after another, an assembly for capping the container by fitting the skirt of a cap to the opening rim portion of a container at a capping position above the path of travel of the holders in the capping station, and an assembly for centering the cap skirt and the container opening rim portion relative to each other comprising a pair of positioning members disposed at the respective opposite sides of the capping position, means for supporting the pair of positioning members movably in the same horizontal direction, and means for moving the pair of positioning members toward or away from each other, the pair of positioning members having opposed faces each including an upward tapered portion for positioning the cap, a downward tapered portion provided under the upward tapered portion for positioning the container and a stepped portion between the two tapered portions, the pair of positioning members, when close to each other, being so shaped that the lower ends of the upward tapered portions thereof are in conformity with the contour of the lower edge of the cap skirt, with the upper ends of the downward tapered portions thereof in conformity with the contour of the container opening rim portion.

3. A packaging machine as defined in claim 2 wherein the moving means includes a pair of hydraulic cylinders opposed to each other and having piston rods connected to the respective positioning members.

4. A packaging machine as defined in claim 2 wherein the cap skirt and the container opening rim portion are circular in contour when seen from above, and the upward tapered portions and the downward tapered portions are each in the form of a circular arc in cross sectional contour.

5. A packaging machine comprising:

a conveyor drivingly movable intermittently for transporting containers having an opening rim portion in a multiplity of rows and having a capping station and a plurality of slats, each of the slats being formed with a plurality of container holding holes arranged longitudinally thereof and each adapted to support the container at its opening rim portion with the hole-defining peripheral edge on the the upper side of the slat, the slats being stoppable at the capping station one after another, an assembly for capping containers by fitting the skirt of a cap to the opening rim portion of the container at each of capping positions above the path of transport of containers in the capping station and equal in number to the number of container holding holes, and an assembly for centering the cap skirt and the container opening rim portion relative to each other for capping at each of the capping positions, the centering assembly comprising positioning members in a plurality of pairs equal in number to the number of capping positions and arranged at opposite sides of the respective capping positions, means for supporting each pair positioning members movably in the same horizontal direction, and means for moving each pair of positioning members toward or away from each other, each pair of positioning members having opposed faces each including an upward tapered portion for positioning the cap, a downward tapered portion provided under the upward tapered portion for positioning the container and a stepped portion between the two tapered portions, each pair of positioning members, when close to each other, being so shaped that the lower ends of the upward tapered portions thereof are in conformity with the contour of the lower edge of the cap skirt, with the upper ends of the downward tapered portions thereof in conformity with the contour of the container opening rim portion.

6. A packaging machine as defined in claim 5 wherein the supporting means comprises a pair of gatelike frames extending over the path of transport of containers and respectively positioned upstream and downstream from the capping station with respect to the direction of transport of containers, the gatelike frames being supported by the frame of the conveyor and each having a horizontal top member, a pair of horizontal guide rods connected between the horizontal top members of the gatelike frames and extending in parallel to the transport direction, four slide sleeves fitted around the pair of guide rods, two on each guide rod, and a pair of movable members each connected between one of the slide sleeves fitted around one of the guide rods and one of the slide sleeves fitted around the other guide rod and positioned at the same side as said one slide sleeve with respect to the direction of transport, each of the movable members having one of the positioning members in each pair attached thereto, the moving means including a pair of hydraulic cylinders opposed to each other and attached to the respective horizontal top members of the gatelike frames each at the lengthwise midportion of the top member, the pair of hydraulic cylinders having their piston rods connected to the respective movable members.

* * * * *